US006966419B2

(12) United States Patent
Tada

(10) Patent No.: US 6,966,419 B2
(45) Date of Patent: Nov. 22, 2005

(54) SAFETY DEVICE FOR A PASSENGER CONVEYOR

(75) Inventor: Shingo Tada, Himeii (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/743,083

(22) Filed: Dec. 23, 2003

(65) Prior Publication Data

US 2004/0134748 A1 Jul. 15, 2004

(30) Foreign Application Priority Data

Dec. 24, 2002 (JP) ..... 2002-372024

(51) Int. Cl.[7] ..... B66B 25/00
(52) U.S. Cl. ..... 198/323
(58) Field of Search ..... 198/323, 325

(56) References Cited

U.S. PATENT DOCUMENTS 2,030,103 A * 2/1936 Dunlop ..... 198/323
5,255,771 A * 10/1993 Nurnberg et al. ..... 198/323
5,398,800 A * 3/1995 Hofling et al. ..... 198/323
5,611,417 A * 3/1997 Stawniak et al. ..... 198/323
6,644,457 B2 * 11/2003 Lauch ..... 198/325

* cited by examiner

*Primary Examiner*—James R. Bidwell
(74) *Attorney, Agent, or Firm*—Oblon, Spivak, McClelland, Maier & Neustadt, P.C.

(57) ABSTRACT

A safety device for a passenger conveyor such as an escalator or a moving walk having an improved safety performance and a simple configuration. The safety device separately detects the forward and upward displacements of a combplate beam 12 with respect to a supporting beam 13 with a single safety switch actuated by a switch actuating member having first and second actuating portions to stop an operation of the passenger conveyor. Thus, the improved safety performance and a simple configuration can be achieved, and a combplate made of aluminum alloy can be used.

14 Claims, 10 Drawing Sheets

SAFETY DEVICE FOR A PASSENGER CONVEYOR

BACKGROUND OF THE INVENTION

1. Field of the Invention

The present invention relates to a safety device for a passenger conveyor such as an escalator or a moving walk, which immediately stops its operation when a passenger's leg or a foreign object is caught in a clearance between a passenger step and a combplate provided at the landing of the passenger conveyor.

More particularly, the present invention relates to a combplate safety device for the passenger conveyor, wherein the combplate can be displaced in two directions, that is, in a passenger's getting on/off direction and in an upward direction, and wherein displacement of the combplate can be detected by a single detecting switch, thus the combplate safety device can be of a simple configuration and can achieve an improved safety performance.

2. Description of the Related Art

In a conventional passenger conveyor such as an escalator 1 or a moving walk shown in FIG. 9, a number of passenger platforms or steps 2 are endlessly connected to each other and are driven by driving chains not shown. Handrails 4 mounted on an outer periphery of a balustrade 3 provided on both right and left sides of the passenger step running path are driven in a synchronizing manner with the passenger steps 2. In this way, a passenger get on the step from a landing 5L on a lower floor is conveyed to a landing 5U on an upper floor.

Landing plates 5*a* provided at the landings 5L and 5U have combplates 6U, 6L, respectively, in order to prevent the passenger from stumbling over the landing plates 5*a*, or from having his or her foot caught in a clearance between the passenger steps 2 and the landing plate 5*a*, when the passenger on the passenger steps 2 gets off therefrom on the landing plates 5*a*.

Each combplate 6U, 6R has a comb teeth 6*a* at its tip which is slidably meshing with a cleat 2*a* provided on the upper surface of the passenger steps 2. Thus, passenger's leg or a foreign object is scooped up so as not to be caught in the clearance.

For the safety, the combplates 6U, 6L are formed of a synthetic resin so that they are easily deformed or broken when the passenger's leg or the foreign object is caught in the clearance and an excessive external load is applied to the combplates 6U, 6R.

As shown in FIG. 10, a safety device for a passenger conveyor has been known, in which a thin detecting bar 7 horizontally extending in a width direction (a direction perpendicular to the drawing sheet) of the passenger step 2 is disposed near under the surface of the combplates 6U, 6R. When the deformed or broken combplates 6U, 6L or passenger's leg contact the detecting bar 7 and displace the same in an getting off direction, a safety switch is actuated to immediately stop the operation of the escalator 1 (See Japanese Patent Publication No. 150987/1986).

Another safety device for a passenger conveyor is known in which a sub-combplate is provided on the combplate such that it can move in a passenger's getting off direction and can swing in a vertical direction, to immediately stop the operation of the passenger conveyor when a displacement of the sub-combplate is detected. (See Japanese Patent Publication No. 73170/1996).

Further, a safety device for a passenger conveyor is known in which the operation of the passenger conveyor is immediately stopped when a detecting switch is actuated by a combplate which is displaced upward by passenger's leg or a foreign object caught in the clearance (See Japanese Patent Publication No. 171457/1999).

However, above mentioned conventional safety devices for a passenger conveyor have many disadvantages as follows.

That is, in the safety device disclosed in the Japanese Patent Publication No. 150987/1986, the combplates 6U, 6R must be formed of a synthetic resin, such that the combplates 6U, 6R are readily broken when an excessive force is applied thereto upon passenger's leg being caught in a clearance between the passenger step 2 and the combplates 6U, 6L. Thus, a combplate formed of an aluminum alloy having an excellent strength and durability can not be used.

In the safety device disclosed in the Japanese Patent Publication No. 73170/1996, a switch for detecting the displacement of the assisting combplate plate in a passenger's getting off direction and a switch for detecting an upward swing of the sub-combplate plate must be separately provided. Thus, these switches complicate the configuration of this safety device.

In the safety device disclosed in the Japanese Patent Publication No. 171457/1999, the operation of the escalator is stopped when a detecting switch is actuated by an upward displacement of the combplate plate. However, since a displacement of the combplate plate in a passenger's getting off direction is not detected, there is a room for further improving the safety performance of this safety device.

SUMMARY OF THE INVENTION

Accordingly, it is an object of the present invention to provide a safety device for a passenger conveyor which solve the above mentioned disadvantages of the conventional safety devices, and has more advantageous safety performance for immediately stopping the operation of the passenger conveyor when passenger's leg or a foreign object is caught in a clearance between a passenger steps and a combplate provided at a landing, and is of a simple configuration with single switch for detecting a displacement of the combplate, and can be used with a combplate made of aluminum alloy having a excellent strength and durability.

In order to solve the above mentioned disadvantages, the present invention provides a safety device for a passenger conveyor which stops the operation of the passenger conveyor when passenger's leg or a foreign object is caught in a clearance between a combplate disposed at a landing of the passenger conveyor and passenger steps, which comprises: a combplate beam on which the combplate is mounted; a supporting beam juxtaposed to the combplate beam; supporting means for supporting the combplate beam with respect to the supporting beam, such that the combplate beam can displace in a passenger's getting on/off direction, and that the combplate beam can swing in vertical direction; a safety switch for stopping an operation of the passenger conveyor, said switch is provided on one of the combplate beam and the supporting beam; and a switch actuating member for actuating the safety switch when the combplate beam is displaced with respect to the supporting beam, said switch actuating member is disposed on the other of the combplate beam and the supporting beam.

In the safety device of the present invention, the switch actuating member includes a first actuating portion for actuating the safety switch when the combplate beam is displaced in a passenger's getting off direction; and a second actuating portion for actuating the safety switch when the combplate beam is displaced upward. As a result, the displacement of the combplate beam in two directions with respect to the supporting beam can be detected by a single safety switch, which allows a simple configuration of the safety device. And, the operation of the passenger conveyor is stopped by separately detecting the displacement of the combplate beam in two directions. Thus, a safety performance of the safety device is further improved.

In addition, the combplate need not break when passenger's leg or a foreign object is caught in the clearance. Thus, the combplate made of an aluminum alloy having excellent strength and durability can be used.

In a safety device for a passenger conveyor of the present invention, the safety device may further comprises a first biasing means for biasing the combplate beam with respect to the supporting beam in a direction in which the passenger gets on the step; a second biasing means for biasing the combplate beam downward with respect to the supporting beam; a first adjusting mechanism for adjusting a biasing force applied by the first biasing means; and a second adjusting mechanism for adjusting a biasing force applied by the second biasing means. Thus, the value of an external force applied to the combplate that are necessary to displace the combplate with respect to the supporting beam in two directions can be separately and properly adjusted.

In a safety device for a passenger conveyor of the present invention, the supporting beam may include a guide slope for guiding the combplate beam such that the combplate beam slides thereon and displace upward when the combplate beam is displaced in a passenger's getting off direction with respect to the supporting beam. Thus, when the combplate beam is displaced in a passenger's getting off direction with respect to the supporting beam, the combplate beam slide on the guide slope and move upward, so that the combplate beam swings upward with respect to the supporting beam. Then, the clearance between the upper surface of the passenger steps and the combplate is enlarged, and thus a force applied to the passenger's leg caught in the clearance can be quickly reduced.

In a safety device for a passenger conveyor of the present invention, the combplate beam may include a pair of supporting rollers which roll on a supporting surface to support a displacement of the combplate beam in a passenger's getting on/off direction. Since the combplate beam is supported by the pair of rollers rolling on the supporting surface, the combplate beam can be smoothly displaced in a passenger's getting on/off direction. As a result, it can be quickly and surely detected that passenger's leg or a foreign object is caught in the clearance. Thus, the safety performance of the safety device is further improved.

In a safety device for a passenger conveyor of the present invention, the supporting beam may include a slide surface on which the combplate beam slides when the combplate beam is displaced in a passenger's getting on/off direction, and a friction reducing means may be provided between the slide surface of the supporting beam and the combplate beam. The friction reducing means may be a low frictional material such as poly-tetra-fluoroethylene applied to the surface of the combplate beam or the slide surface. Alternatively, the friction reducing means may be a bearing such as a needle roller bearing, or an oil-retaining metal. Since the frictional reducing means is provided between the combplate beam and the supporting beam, the combplate beam can be smoothly displaced in a passenger's getting off direction when a foot or a foreign object is caught in a clearance between the upper surface of the passenger step and the combplate. Therefore, the displacement of the combplate can be quickly and surely detected and the safety performance is enhanced.

Further, the disclosure of Japanese Patent Application No. 372024/2002 filed on Dec. 24, 2002 including the specification, drawings and abstract is incorporated herein by reference in its entirety.

DETAILED DESCRIPTION OF THE INVENTION

An embodiment of a safety device for a passenger conveyor according to the present invention is described hereafter in detail with reference to FIGS. 1 to 8.

In the below description, the term "forward" means a direction where the passenger get off from a passenger step to a landing plate, the term "rearward" means a direction where the passenger gets on a passenger step from the landing plate, and the term "right and left direction" means a horizontal direction perpendicular to a running direction of the passenger step.

A safety device for a passenger conveyor 100 (hereinafter abbreviated as "safety device") according to the present invention shown in FIGS. 1 to 8 is provided on an escalator 1 shown in FIG. 9 at a landing 5U in an upper floor and a landing 5L in a lower floor. The safety device 100 immediately stops an operation of the escalator 1 when passenger's leg or a foreign object is caught in a clearance between a passenger step 2 and a combplate 10.

Although only the safety device 100 provided at the landing 5U in an upper floor is illustrated, the safety device provided at the landing 5L in a lower floor has the same configuration.

Figure 1:
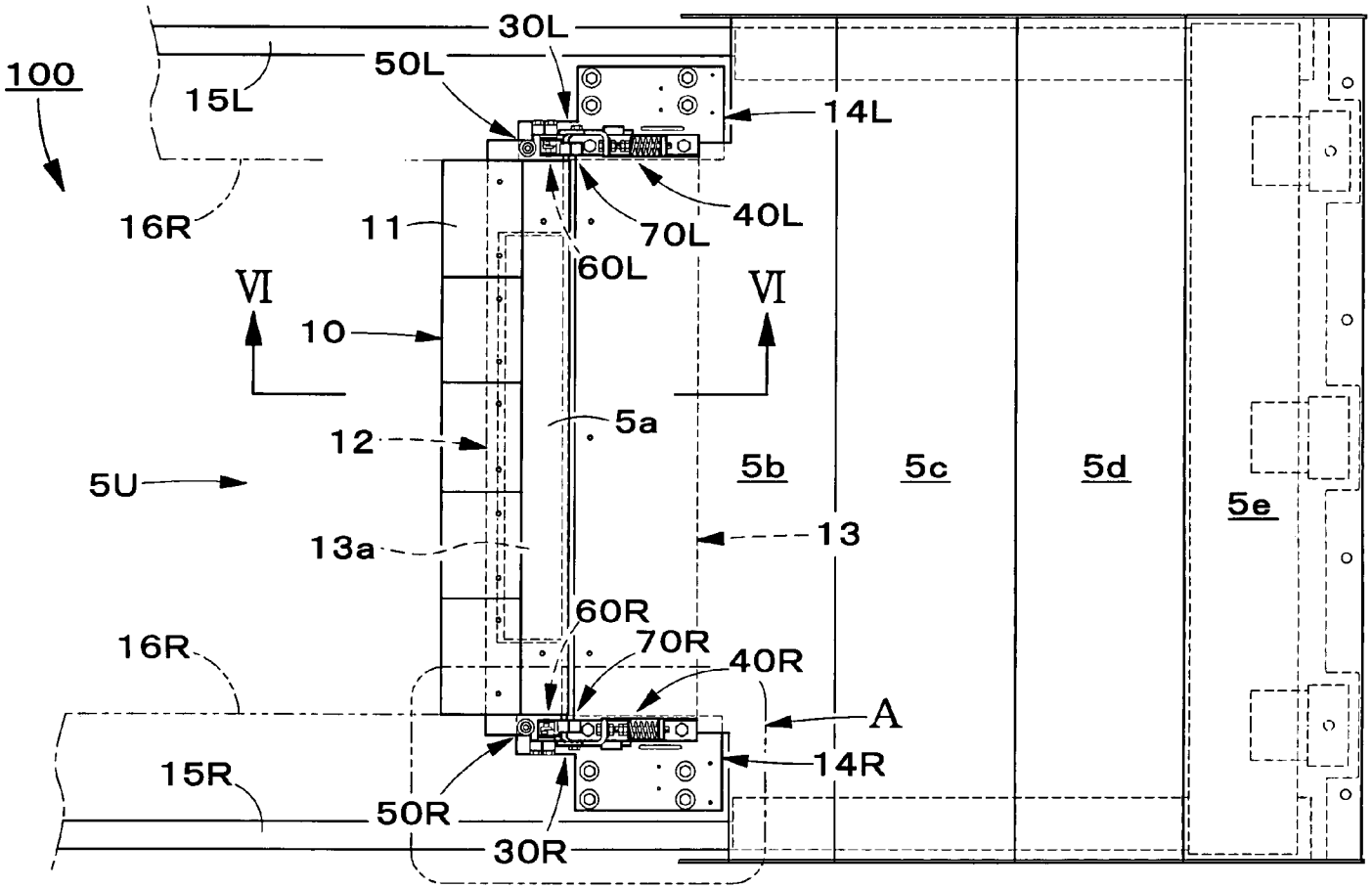
FIG. 1 is an overall plan view showing an embodiment of a safety device for a passenger conveyor according to the present invention.
Figure 2:
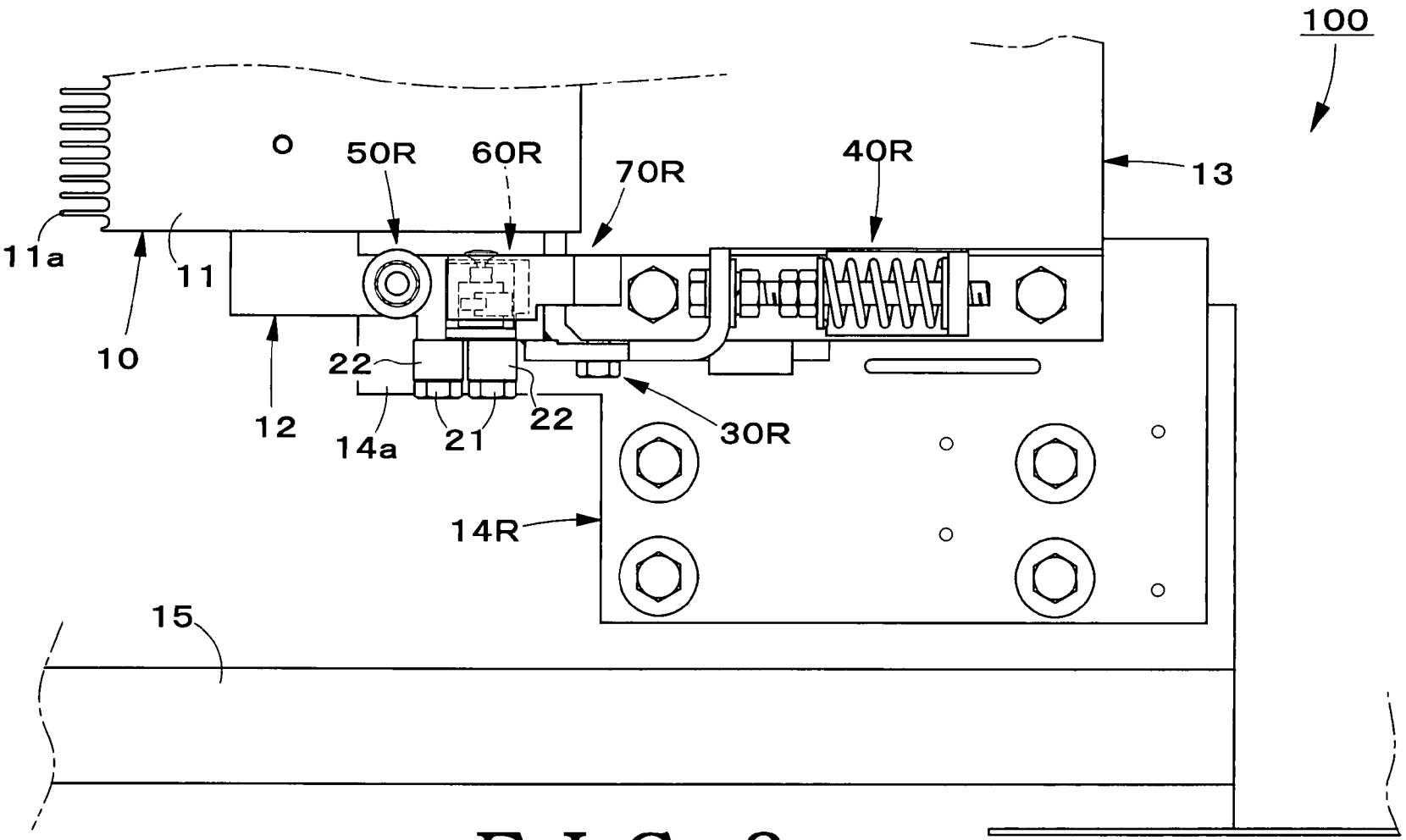
FIG. 2 is a enlarged plan view showing a circled portion "A" in FIG. 1.

As shown in FIGS. 1 and 2, the safety device 100 according to the present embodiment includes a combplate 10 divided into five members in a right and left direction (an up and down direction shown in the drawings); a combplate beam 12 to which five combplate members 11 are attached, the combplate beam 12 horizontally extending in a right and left direction; and a supporting beam 13 juxtaposed to a front side of the combplate beam 12, the supporting beam 13 horizontally extending in a right and left direction.

Figure 6:
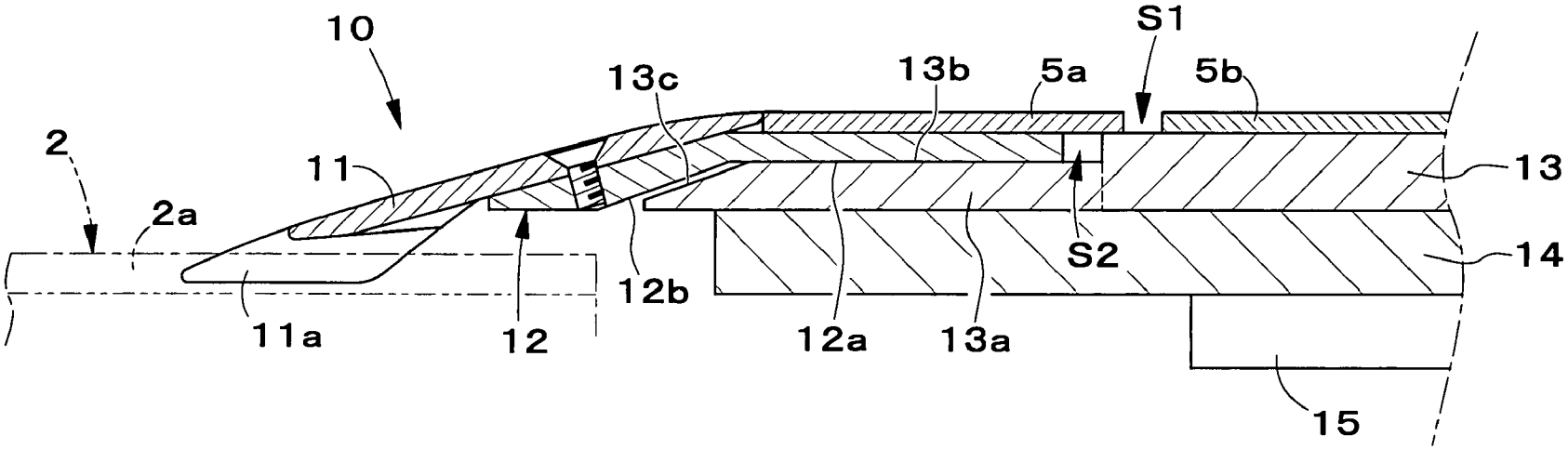
FIG. 6 is a cross-sectional side view taken along the line VI—VI in FIG. 1.

As shown in FIGS. 1 and 6, a landing plate 5*a* is secured on an upper surface of the combplate beam 12, while a landing plate 5*b* is secured on an upper surface of the supporting beam 13.

Because of space "S1" between the landing plates 5*a* and 5*b* and a space "S2" between the combplate beam 12 and the supporting beam 13, the combplate beam 12 and the landing plate 5*a* can be relatively displaced forward (rightward in the drawing) with respect to the supporting beam 13 and the landing plate 5*b*.

As shown in FIG. 1, landing plates 5*c* to 5*e*, which are closely in contact with other, are juxtaposed to a front side of the landing plate 5*b*.

The combplate beam 12 has a pair of front and rear rotation-supporting rollers 22 at both right and left ends thereof. The rotation-supporting rollers 22 are rotatably supported by spindles 21.

The pair of rotation-supporting rollers 22 rotates on upper surfaces of parts 14*a* which are rearwardly extended from a pair of right and left combplate beam receiving portions 14L, 14R. The pair of right and left combplate beam receiving portions 14L, 14R are disposed on the combplate beam 12 and the supporting beam 13 in a juxtaposing manner. Thus, the combplate beam 12 is smoothly displaced in a front and rear direction.

As shown in FIGS. 1 and 6, a center part 13*a* in a right and left direction of the supporting beam 13 is projected rearward below the combplate beam 12 so as to support the same from below.

A recessed portion 12*a* is formed on a lower surface of the combplate beam 12 at a position opposed to the center part 13*a* of the supporting beam 13.

When the combplate beam 12 is displaced forward (rightward in the drawing), an upper surface 13*b* of the center part 13*a* of the supporting beam 13 provides a slide surface on which a bottom surface of the recessed portion 12*b* of the combplate beam 12 is slid.

A low frictional material such as poly-tetra-fluoroethylene is applied to the upper surface 13*b* of the supporting beam 13 so as to reduce a friction generated when the combplate beam 12 is slid thereon.

A guide slope 13*b* is provided at a rear end of the center part 13*a* of the supporting beam 13. With the provision of the guide slope 13*b*, the combplate beam 12 and thus the combplate 10 are displaced upward, when the combplate beam 12 is displaced forward.

As shown in FIG. 1, the combplate beam 12 is supported on the supporting beam 13 by a pair of right and left supporting means 30L, 30R.

Since the pair of right and left supporting means 30L, 30R are symmetrical and have the same configuration, the supporting means 30R on the right is described with reference to FIG. 2.

Figure 3:
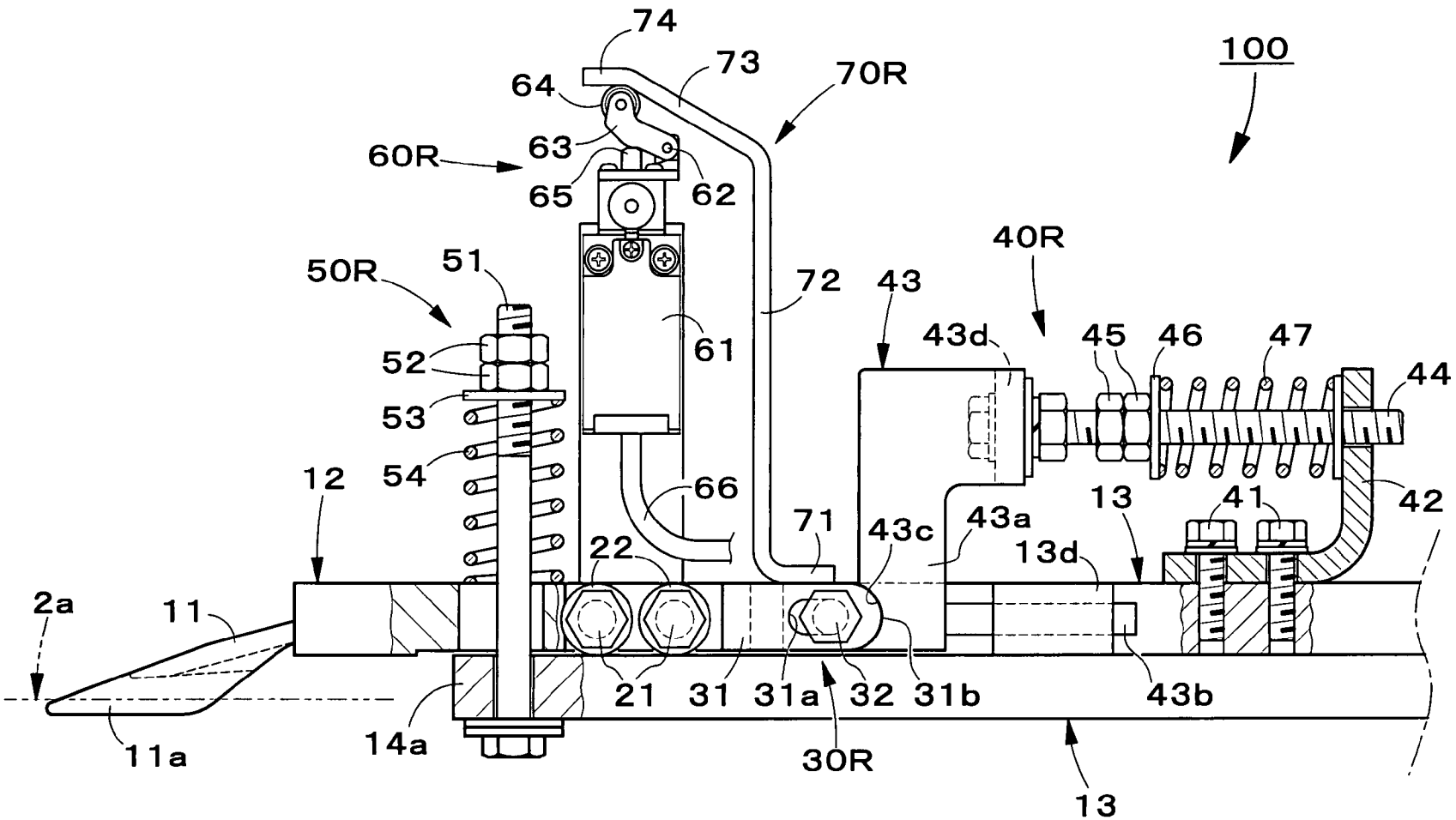
FIG. 3 is a enlarged side cross-sectional view of the main part of the circled portion "A" in FIG. 1.
Figure 4:
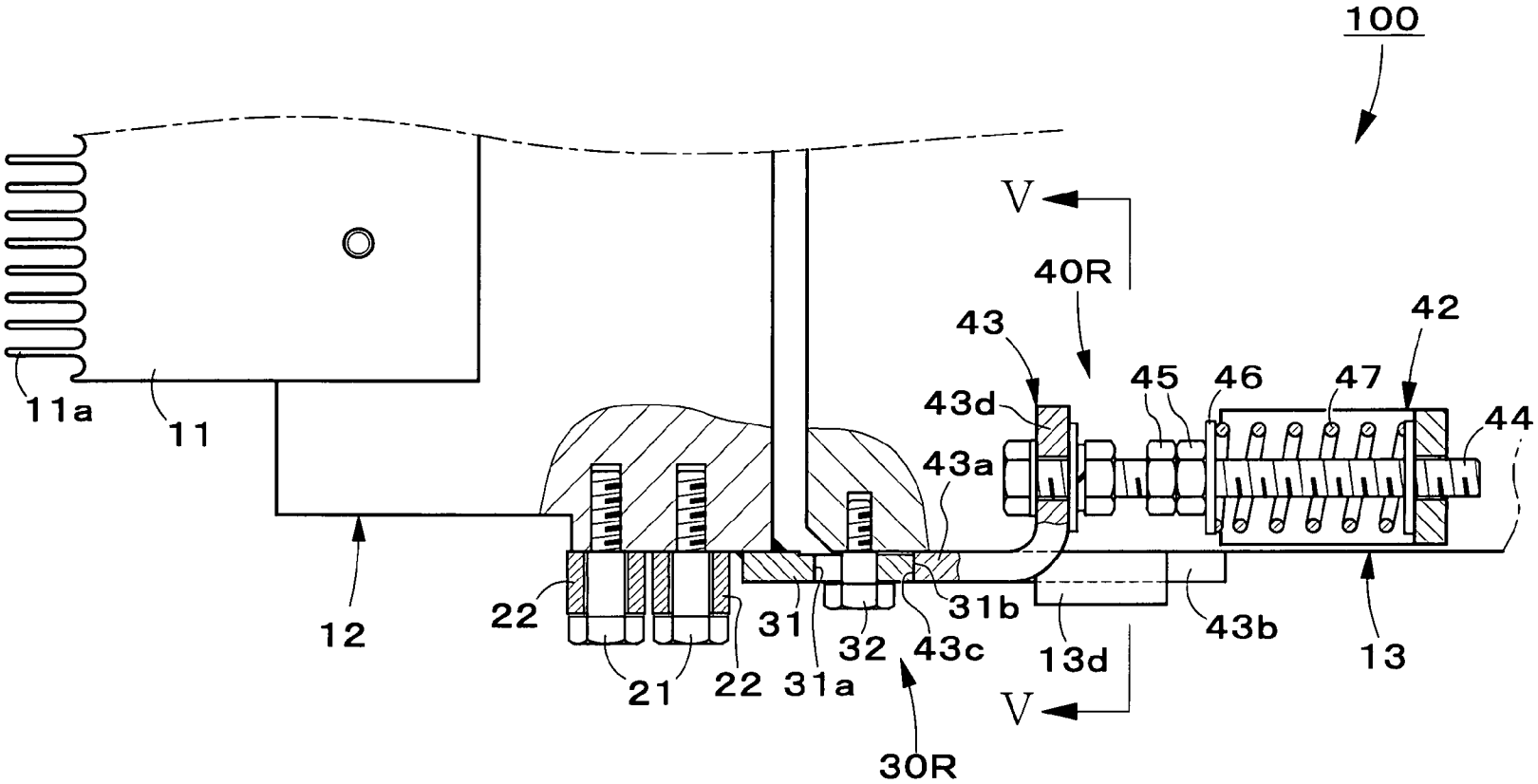
FIG. 4 is a cross-sectional plan view showing a main part of supporting means and first biasing means shown in FIG. 3.

As shown in FIGS. 3 and 4 in enlargement, the supporting means 30R includes a band-plate like bracket 31 and a swing shaft 32. The bracket 31 is welded to a front end of a right side surface of the combplate beam 12 to extend forward. The swing shaft 32 is planted at a rear end of a right side surface of the supporting beam 13 to horizontally extend in a right and left direction.

The swing shaft 32 is movably fitted in an elongate hole 31*a* disposed through the bracket 31 to extend in a front and rear direction.

A front end 31*b* of the bracket 31 is formed in a semicircular shape.

Thus, the combplate beam 12 is supported on the supporting beam 13 such that the combplate beam 12 is displaceable in a front and rear direction with respect to the supporting beam 13 within a range of a dimension of the elongate hole 31*a*, and that the combplate beam 12 is swingable in an up and down direction about an axis of the swing shaft 32.

Note that the combplate beam 12 is supported by the pair of rotation-support rollers 22, and is supported by the center part 13*a* of the supporting beam 13, as described above. Thus, the combplate beam 12 cannot be swung in a counter-clockwise direction from a horizontal state shown in FIG. 3, but can only be swung in a clockwise direction.

The combplate beam 12 is constantly biased rearward with respect to the supporting beam 13 by means of a first pair of right and left biasing means 40L, 40R which are respectively disposed on right and left ends of the supporting beam 13.

Figure 5:
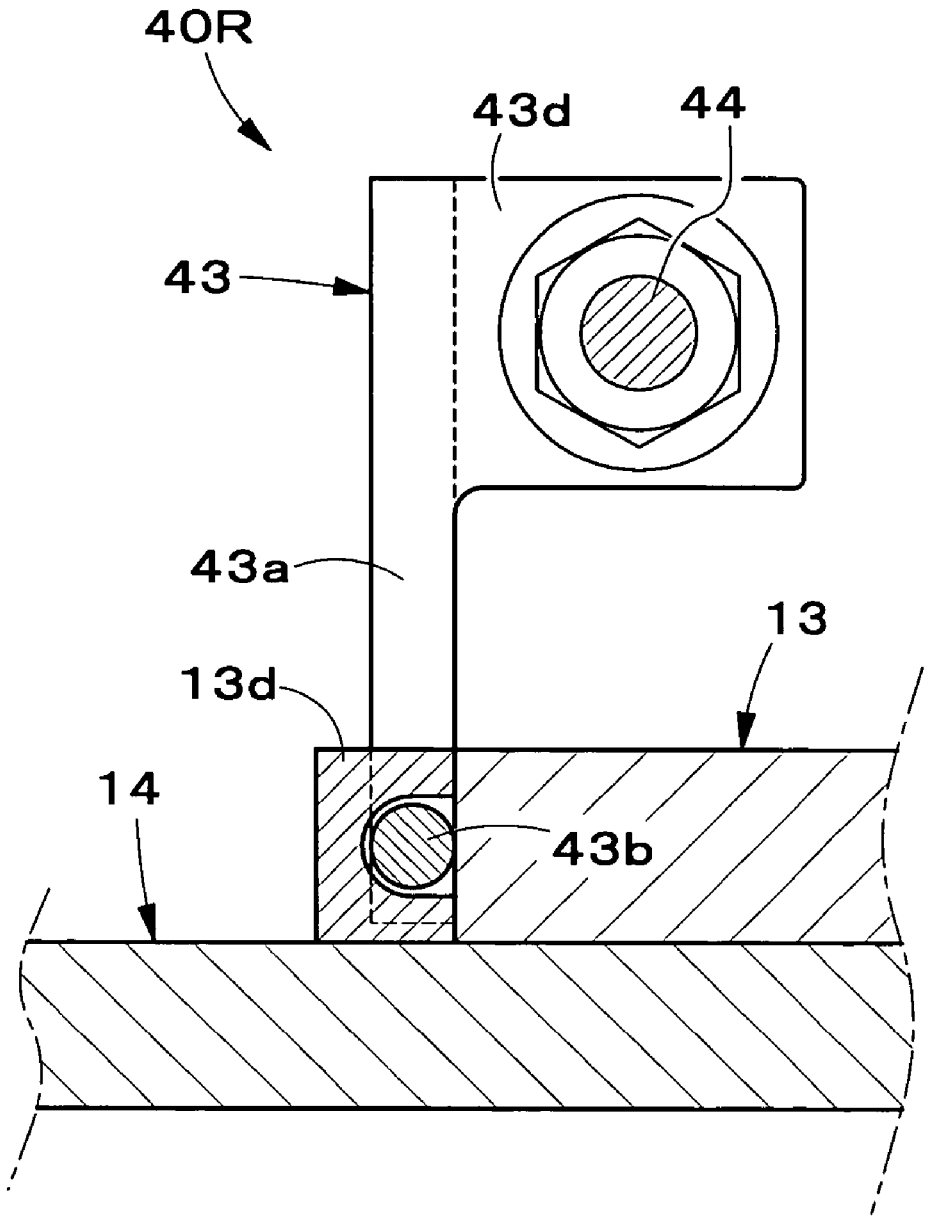
FIG. 5 is a cross-sectional front view taken along the line V—V in FIG. 4.

Since the first pair of right and left biasing means 40L, 40R are symmetrical and have the same configuration, the supporting means 30R on the right is described with reference to FIGS. 3 to 5.

As shown in FIGS. 3 and 4 in enlargement, the first biasing means 40R includes a first bracket 42 of a reverse-L shape in cross-section and a second bracket 43 of an L-shape in plan view. The first bracket 42 is secured to an upper surface of the supporting beam 13 at a right end thereof by a pair of front and rear bolts 41. The second bracket 43 is supported such that the bracket 43 is displaceable in front and rear direction with respect to the supporting beam 13.

The second bracket 43 has a portion 43*a* extending in an up and down direction, and a shaft portion 43*b* of a round bar shape secured on a front surface of the portion 43*a* at a lower end thereof to project forward. As shown in FIG. 5, the supporting beam 13 has a support member 13*d* secured on a right side surface thereof. The support member 13*d* is formed in substantially a C-shape in cross-section. The shaft portion 43*b* is slidably movably fitted in the support member 13*d* to be displaceably supported in a front and rear direction with respect to the supporting beam 13.

A recessed portion 43*c* of a semicircular shape is formed in a lower end of a rear surface of the portion 43*a* extending in an up and down direction. The recessed portion 43*c* is closely in contact with an outer periphery of the semicircular end 31*b* of the bracket 31 of the supporting means 30 described above.

The second bracket 43 has a portion 43*d* at an upper part thereof which is extended in a right and left direction. A head of a bolt 44 extending forward is secured on the portion 43*d*.

A compression spring 47 is interposed between a washer 46 and the first bracket 42 so as to constantly urge the second bracket 43 rearward. The washer 46 is positioned in a front and rear direction by a double nut 45 (a first adjusting mechanism) screw-threaded in the bolt 44.

Under this state, the second bracket 43 is displaceably supported in a front and rear direction with respect to the supporting means 13. The semicircular recessed portion 43*c* of the second bracket 43 is closely in contact with the front end 31*b* of the bracket 31 of the supporting means 30R.

Thus, the first biasing means 40R constantly urges the combplate beam 12 rearward through the bracket 31 of the supporting means 30R.

By adjusting the position of the double nut 45 in a front and rear direction, a compressing amount of the compression spring 47 is varied so as to adjust a degree of an biasing force which urges the combplate beam 12 rearward.

The front end 31*b* of the bracket 31 of the supporting means 30R is of a semicircular shape, and the recessed portion 43*c* of the second bracket 43 is of a semicircular shape. Since the front end 31*b* and the recessed portion 43*c* are fitted with each other, both remain in contact with each other when the combplate beam 12 is swung about the swing shaft 32.

As a result, when the combplate beam 12 is swung about the swing shaft 32 with respect to the supporting beam 13, the combplate beam 12 can be constantly biased rearward by the first biasing means 40R.

The combplate beam 12 is constantly biased downward with respect to the supporting beam 13 by a second pair of right and left biasing means SOL, 50R, which are respectively attached to the rear ends 14*a* of the pair of right and left combplate beam receiving portions 14L, 14R.

Since the second pair of right and left biasing means SOL, 50R are symmetrical and have the same configuration, the second biasing means 50R on the right is described with reference to FIG. 3.

As shown in FIG. 3, the second biasing means 50R includes a bolt 51 extending upward, a washer 53, and a compression spring 54 interposed between the washer 53 and an upper surface of the combplate beam 12. The bolt 51 is inserted in a through-hole 14*b* which is disposed through the rear end 14*a* of the combplate beam receiving portion 14. The washer 53 is positioned in an up and down direction by a double nut 52 (a second adjusting mechanism) screw-threaded in the bolt 51.

By adjusting the position of the double nut 52 in an up and down direction, a compressing amount of the compression spring 54 is varied so as to adjust a degree of an biasing force which urges the combplate beam 12 downward.

A pair of right and left safety switches 60L, 60R are disposed on both right and left ends of the combplate beam 12, respectively. The pair of safety switches 60L, 60R detect a relative displacement of the combplate beam 12 with respect to the supporting beam 13 to stop an operation of the escalator (passenger conveyor) 1.

Since the pair of right and left safety switches 60L, 60R are symmetrical and have the same configuration, the safety switch 60R on the right is described with reference to FIG. 3.

As shown in FIG. 3, the safety switch 60R includes a body portion 61 secured on an upper surface of the combplate beam 12 to extend in an up and down direction, and a lever 63 supported by a spindle 62 to be swingable in an up and down direction. The spindle 62 is disposed on an upper end of the body portion 61 to extend in a right and left direction.

When a roller 64 disposed on a swinging end of the lever 63 is pushed by a switch actuating member 70, which is described below, the lever 63 depresses a rod 65. Then, an energization of a wiring 66 connected to a not-shown controller of the escalator 1 is blocked, and an operation of the escalator 1 is immediately stopped by the controller.

A pair of right and left switch actuating members 70L, 70R are disposed on both right and left ends of the supporting beam 13 to be adjacent to the pair of right and left safety switches 60L, 60R, respectively.

Since the pair of right and left switch actuating members 70L, 70R are symmetrical and have the same configuration, the switch actuating member 70R on the right is described with reference to FIG. 3.

As shown in FIG. 3, the switch actuating member 70R is formed by folding a thick steel plate with a press work. The switch actuating member 70R includes a portion 71 secured on an upper surface of the supporting beam 13, a first actuating portion 73, and a second actuating portion 74. The first actuating portion 73 is connected with an upper end of a portion 72 extending in an up and down direction, and is extended rearward and inclined upward. The second actuating portion 74 is connected with a rear end of the first actuating portion 73, and is extended horizontally rearward.

When the combplate beam 12 is displaced forward with respect to the supporting beam 13, the first actuating member 73 bears against the roller 64 of the safety switch 60R so as to depress the rod 65.

When the combplate beam 12 is swung about the swing shaft 32 to displace forward with respect to the supporting beam 13, the second actuating member 74 bears against the roller 64 of the safety switch 60R so as to depress the rod 65.

As shown in FIG. 1, the first pair of right and left biasing means 40L, 40R; the second pair of right and left biasing means 50L, 50R; the pair of right and left safety stitches 60L, 60R; and the pair of right and left switch actuating members 70L, 70R, all of which are described above, are contained inside a pair of right and left skirt guards 16L, 16R which are respectively attached to trusses 15. Thus, passengers utilizing the escalator 1 cannot see such elements.

Figure 7:
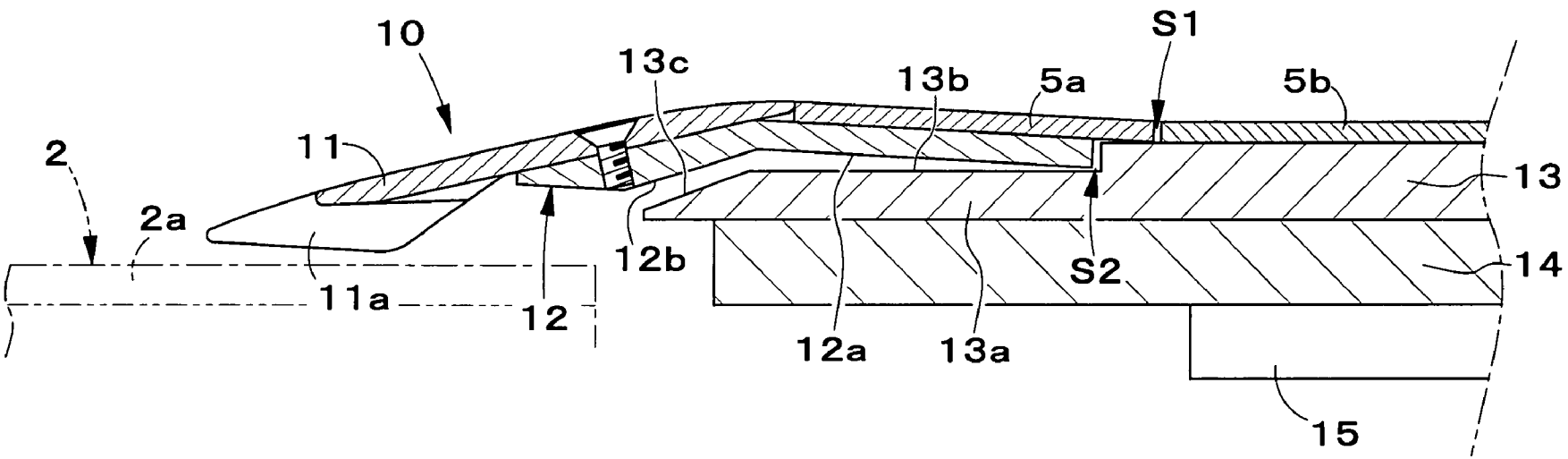
FIG. 7 is a side view showing a cross-section taken along the line VI—VI in FIG. 1, in which a displacement of a combplate beam with respect to a supporting beam is illustrated.

An actuation of the safety device 100 according to the present embodiment which has above-described configuration is described hereinbelow with reference to FIGS. 7 and 8.

Figure 9:
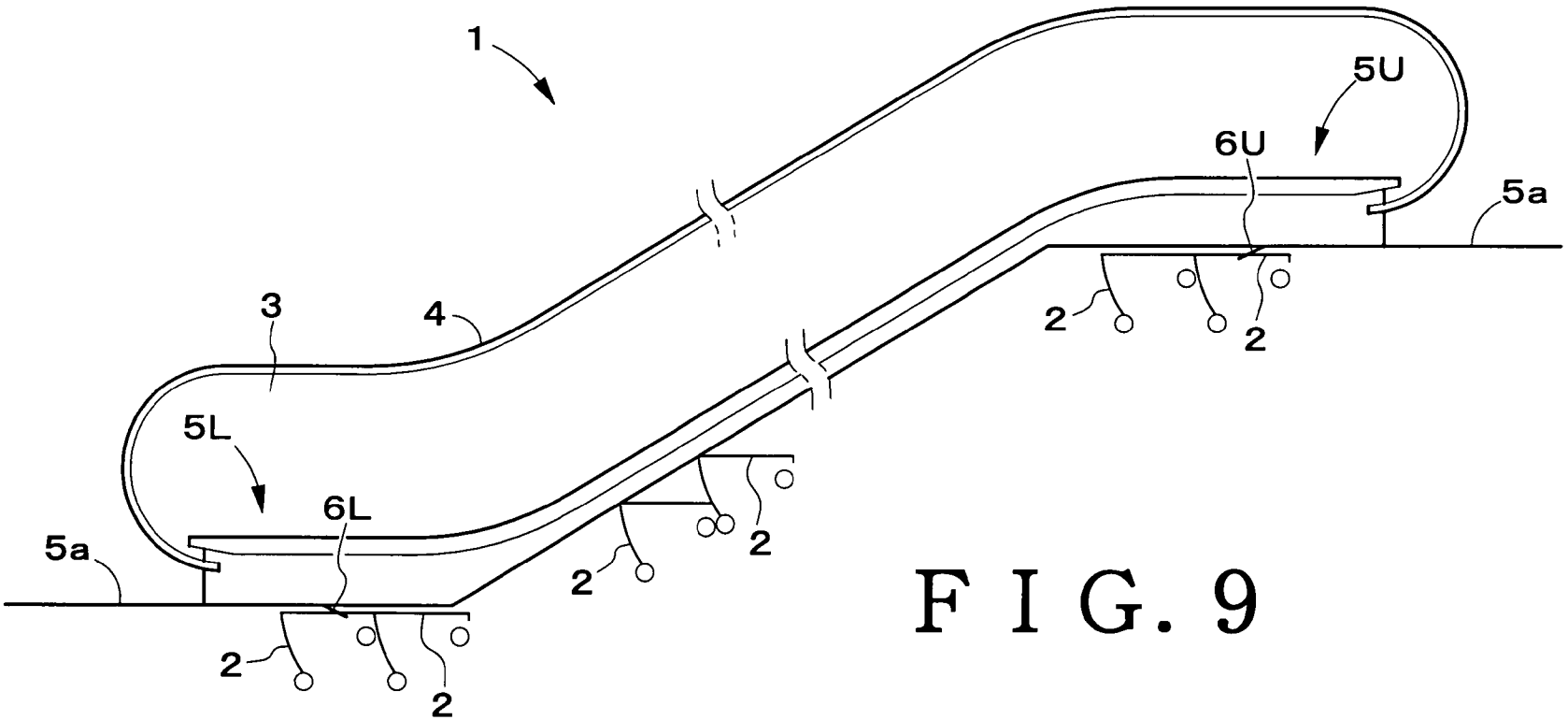
FIG. 9 is a side view schematically showing a configuration of a conventional elevator.
Figure 10:
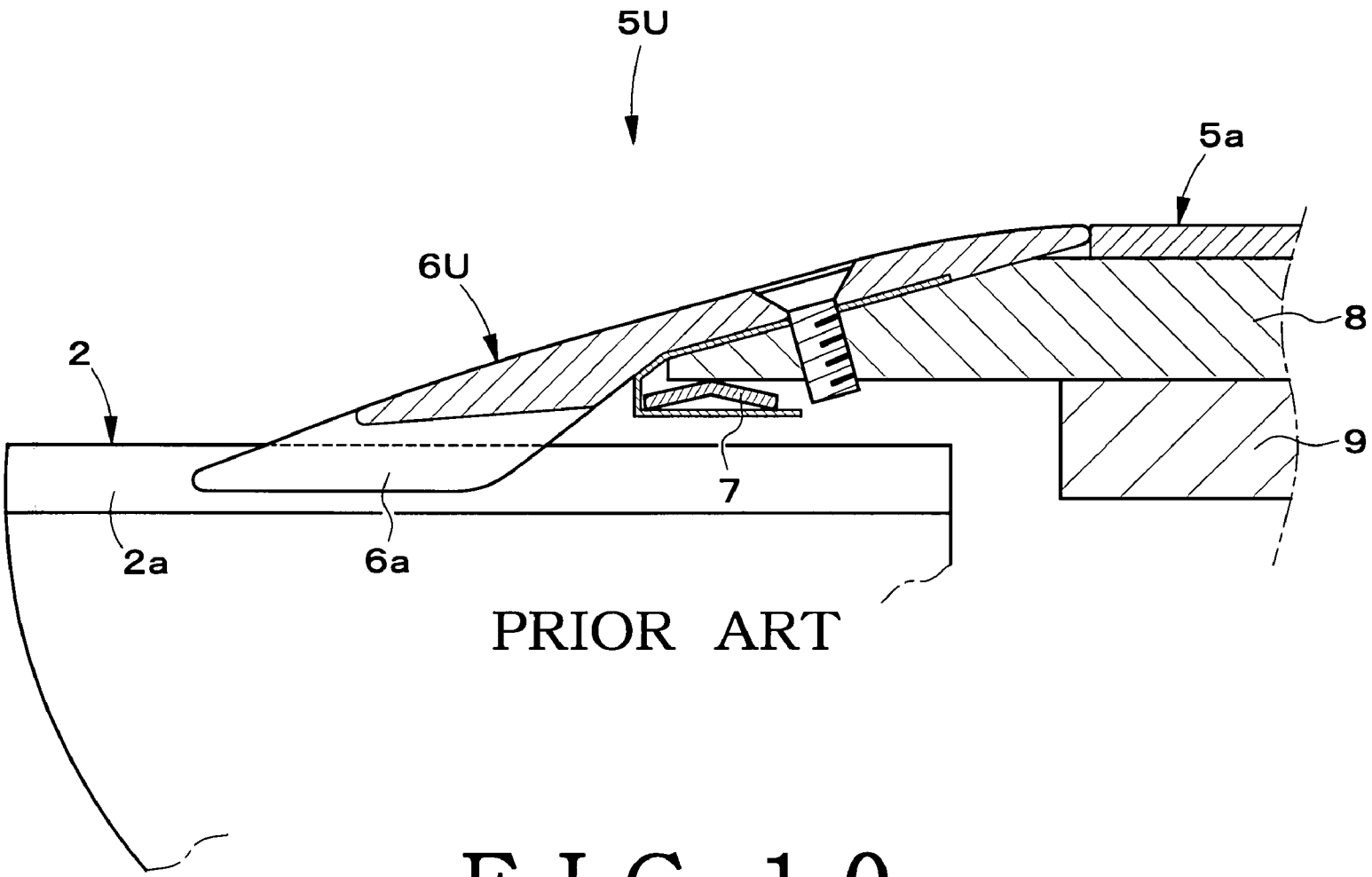
PRIOR ART FIG. 10
FIG. 10 is a cross-sectional view showing a conventional safety device.

In getting off the landing plates 5*a* to 5*e* from the passenger step 2 at the landing 5U in an upper floor of the escalator 1 shown in FIG. 9, when the passenger stumbles over the combplate 10 of the safety device 100 shown in FIG. 1, the combplate 10 is pushed forward by passenger's leg, and then the combplate 10 together with the combplate beam 12 is relatively displaced forward with respect to the supporting beam 13.

The pair of rotation-supporting rollers 22 are disposed at both right and left ends of the combplate beam 12, and a low frictional material such as poly-tetra-fluoroethylene is applied to the slide surface 13*b* of the supporting beam 13. Thus, the combplate beam 12 can be relatively displaced forward with respect to the supporting beam 13 in a smooth manner.

In this way, when passenger's leg or a foreign object is caught in a clearance between the passenger step 2 and the combplate 10, the combplate 10 and the combplate beam 12 are immediately displaced forward. Thus, by detecting this displacement, it is possible to immediately stop an operation of the escalator 1.

The guide slope 13*c* is provided at a rear end of the center part 13*a* of the supporting beam 13. Thus, as shown in FIG. 7, the combplate beam 12 displacing forward climbs over the guide slope 13*c* to be displaced upward. Then, as shown in FIG. 8, the combplate beam 12 is swung about the swing shaft 32 in a clockwise direction in the drawing.

Figure 8:
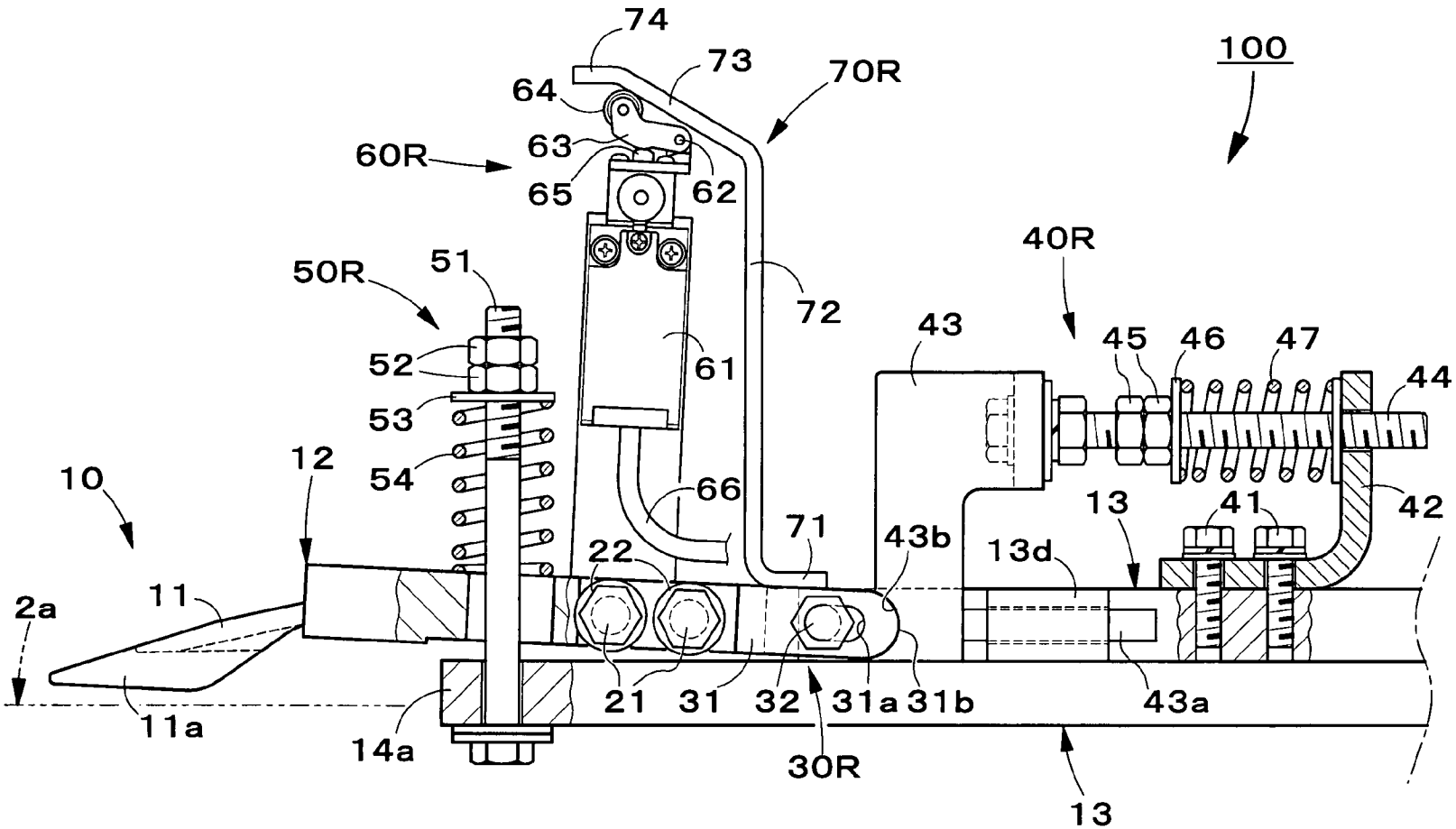
FIG. 8 is a enlarged cross-sectional side view showing the circled portion "A" in FIG. 1, in which a displacement of a combplate beam with respect to a supporting beam and an actuation of a safety switch are illustrated.

In this way, as shown in FIG. 8, a clearance between the upper surface of the passenger step 2 and the combplate 10 is enlarged in up and down direction. Thus, an external force applied to the foot caught in a clearance between the upper surface of the passenger step 2 and the combplate 10 can be reduced at once, so that it is possible to surely prevent the passenger or a foreign object from being injured or damaged.

On the one hand, when passenger's leg is caught in a clearance between the passenger step 2 and the combplate 10, the combplate beam 12 is relatively displaced forward with respect to the supporting beam 13. Then, the roller 64 of the safety switch 60R bears against the first actuating portion 73 of the switch actuating member 70R so as to depress the rod 65.

Thus, the safety switch 60R is actuated to immediately stop an operation of the escalator 1.

On the other hand, when passenger's leg is caught in a clearance between the passenger step 2 and the combplate 10, the combplate beam 12 is relatively displaced upward with respect to the supporting beam 13. Then, the roller 64 of the safety switch 60R bears against the second actuating portion 74 of the switch actuating member 70R so as to depress the rod 65.

Thus, the safety switch 60 is actuated so as to immediately stop an operation of the escalator 1.

In the safety device 100 according to the present invention, since the switch actuating member 70R has the first and second actuating portions 73 and 74 which are integrally formed therewith, both forward and upward displacements of the combplate beam 12 with respect to the supporting beam 13 can be detected by the single safety switch 60R.

Thus, there is no need for disposing separately a safety switch for detecting a forward displacement of the combplate beam 12 and a safety switch for detecting an upward displacement of the combplate beam 12, which allows a configuration of the safety device 100 to be simple.

The safety device 100 according to the present invention can respectively detect forward and upward displacements of the combplate beam 12 with respect to the supporting beam 13 so as to immediately stop an operation of the escalator 1. Thus, a safety performance of the safety device 100 is further improved.

In the safety device 100 according to the present invention, a degree of an biasing force of the first biasing means 40R which urges the combplate beam 12 rearward can be adjusted by means of the first adjusting mechanism 45, and a degree of an biasing force of the second biasing means 50R which urges the combplate beam 12 downward can be adjusted by means of the second adjusting mechanism 52.

Thus, it can be separately and optimally set a value of a forward external force applied to the combplate 10 which causes the safety switch 60R to actuate, and set a value of a downward external force applied to the combplate 10 which causes the safety switch 60R to actuate. Thus, a safety performance of the safety device 100 is further improved.

In addition, it is not needed to brake the combplate down when passenger's leg or a foreign object is caught in a clearance between the passenger step 2 and the combplate. Thus, the combplate 10 formed of an aluminum alloy can be used, which is excellent in strength and endurance.

One embodiment of a safety device for a passenger conveyor according to the present invention has been described above in detail. However, the present invention is not limited thereto, and various changes and modifications are possible.

For example, in the above embodiment, the pair of safety switches 60L, 60R are disposed on the combplate beam 12, and the pair of switch actuating members 70L, 70R are secured to the supporting beam 13. However, the pair of switch actuating member 70L, 70R may be secured to the combplate beam 12, and the pair of safety switches 60L, 60R may be disposed on the supporting beam 13.

Although the above pair of safety switches 60L, 60R are configured as limit switches, they may be proximity switches or photoelectric switches.

As apparent from the foregoing description, a safety device for a passenger conveyor according to the present invention separately detects respective forward and upward displacements of a combplate beam with respect to a supporting beam so as to stop an operation of the passenger conveyor, while a single safety switch is actuated by a switch actuating member having first and second actuating portions. Thus, the safety device further improves in quality, and has a simple configuration.

While a preferred embodiment has been described, it is to be understood that changes and variations may be made without departing from the spirit or scope of the following claims.

What is claimed is:

1. A safety device for a passenger conveyor which stops an operation of the passenger conveyor when passenger's leg or a foreign object is caught in a clearance between a combplate disposed at a landing of the passenger conveyor and a passenger step, comprising:

a combplate beam on which the combplate is mounted;

a supporting beam juxtaposed to the combplate beam;

supporting means for supporting the combplate beam with respect to the supporting beam, such that the combplate beam can displace in a passenger's getting on/off direction, and that the combplate beam can swing in vertical direction;

a safety switch for stopping an operation of the passenger conveyor, said switch is provided on one of the combplate beam and the supporting beam;

a switch actuating member for actuating the safety switch when the combplate beam is displaced with respect to the supporting beam, said switch actuating member is disposed on the other of the combplate beam and the supporting beam;

a first biasing means for biasing the combplate beam with respect to the supporting beam in a direction in which the passenger gets on the step;

a second biasing means for biasing the combplate beam downward with respect to the supporting beam;

a first adjusting mechanism for adjusting a biasing force applied by the first biasing means; and a second adjusting mechanism for adjusting a biasing force applied by the second biasing means wherein said switch actuating member includes a first actuating portion for actuating the safety switch when the combplate beam is displaced in the passenger's getting on/off direction, and a second actuating portion for actuating the safety switch when the combplate beam is displaced upward.

2. A safety device for a passenger conveyor according to claim 1, wherein said supporting beam has a guide slope for guiding the combplate beam to slide thereon and displace upward, when the combplate beam is displaced in a passenger's getting off direction with respect to the supporting beam.

3. A safety device for a passenger conveyor according to claim 1, wherein said combplate beam has a pair of supporting rollers rolling on a supporting surface to support the combplate beam such that the combplate can move in a passenger's getting on/off direction.

4. A safety device for a passenger conveyor according to claim 1, wherein said supporting beam has a slide surface on which the combplate beam is slid when the combplate beam is displaced in a passenger's getting on/off direction, and wherein a friction reducing means is provided between the slide surface of the supporting beam and the combplate beam.

5. A safety device for a passenger conveyor which stops an operation of the passenger conveyor when passenger's leg or a foreign object is caught in a clearance between a combplate disposed at a landing of the passenger conveyor and a passenger step, comprising:

a combplate beam on which the combplate is mounted;

a supporting beam juxtaposed to the combplate beam;

supporting means for supporting the combplate beam with respect to the supporting beam, such that the combplate beam can displace in a passenger's getting on/off direction, and that the combplate beam can swing in vertical direction;

a safety switch for stopping an operation of the passenger conveyor, said switch is provided on one of the combplate beam and the supporting beam; and a switch actuating member for actuating the safety switch when the combplate beam is displaced with respect to the supporting beam, said switch actuating member is disposed on the other of the combplate beam and the supporting beam;

wherein said safety switch includes a rod adapted to stop an operation of the passenger conveyor when the rod is depressed by the switch actuating member;

wherein said switch actuating member is formed as a single member and includes a first actuating portion for actuating the safety switch by depressing said rod when the combplate beam is displaced in the passenger's getting on/off direction, and a second actuating portion for actuating the safety switch by depressing said rod when the combplate beam is displaced upward;

and wherein said second actuating portion is connected with an end of said first actuating portion in an inclined manner with respect to the first actuating portion.

6. A safety device for a passenger conveyor according to claim 5, further comprising:

a first biasing means for biasing the combplate beam with respect to the supporting beam in a direction in which the passenger gets on the step;

a second biasing means for biasing the combplate beam downward with respect to the supporting beam;

a first adjusting mechanism for adjusting a biasing force applied by the first biasing means; and a second adjusting mechanism for adjusting a biasing force applied by the second biasing means.

7. A safety device for a passenger conveyor according to claim 5, wherein said supporting beam has a guide slope for guiding the combplate beam to slide thereon and displace upward, when the combplate beam is displaced in a passenger's getting off direction with respect to the supporting beam.

8. A safety device for a passenger conveyor according to claim 5, wherein said combplate beam has a pair of supporting rollers rolling on a supporting surface to support the combplate beam such that the combplate can move in a passenger's getting on/off direction.

9. A safety device for a passenger conveyor according to claim 5, wherein said supporting beam has a slide surface on which the combplate beam is slid when the combplate beam is displaced in a passenger's getting on/off direction, and wherein a friction reducing means is provided between the slide surface of the supporting beam and the combplate beam.

10. A safety device for a passenger conveyor which stops an operation of the passenger conveyor when passenger's leg or a foreign object is caught in a clearance between a combplate disposed at a landing of the passenger conveyor and a passenger step, comprising:

a combplate beam on which the combplate is mounted;

a supporting beam juxtaposed to the combplate beam;

supporting means for supporting the combplate beam with respect to the supporting beam, such that the combplate beam can displace in a passenger's getting on/off direction, and that the combplate beam can swing in vertical direction;

a safety switch for stopping an operation of the passenger conveyor, said switch is provided on one of the combplate beam and the supporting beam; and a switch actuating member for actuating the safety switch when the combplate beam is displaced with respect to the supporting beam, said switch actuating member is disposed on the other of the combplate beam and the supporting beam;

wherein said safety switch includes a rod adapted to stop an operation of the passenger conveyor when the rod is depressed in a direction transverse to the passenger's getting on/off direction by the switch actuating member;

wherein said switch actuating member includes a first actuating portion for actuating the safety switch by depressing said rod when the combplate beam is displaced in the passenger's getting on/off direction, and a second actuating portion for actuating the safety switch by depressing said rod when the combplate beam is displaced upward;

and wherein said second actuating portion is connected with an end of said first actuating portion in an inclined manner with respect to the first actuating portion.

11. A safety device for a passenger conveyor according to claim 10, further comprising:

a first biasing means for biasing the combplate beam with respect to the supporting beam in a direction in which the passenger gets on the step;

a second biasing means for biasing the combplate beam downward with respect to the supporting beam;

a first adjusting mechanism for adjusting a biasing force applied by the first biasing means; and a second adjusting mechanism for adjusting a biasing force applied by the second biasing means.

12. A safety device for a passenger conveyor according to claim 10, wherein said supporting beam has a guide slope for guiding the combplate beam to slide thereon and displace upward, when the combplate beam is displaced in a passenger's getting off direction with respect to the supporting beam.

13. A safety device for a passenger conveyor according to claim 10, wherein said combplate beam has a pair of supporting rollers rolling on a supporting surface to support the combplate beam such that the combplate can move in a passenger's getting on/off direction.

14. A safety device for a passenger conveyor according to claim 10, wherein said supporting beam has a slide surface on which the combplate beam is slid when the combplate beam is displaced in a passenger's getting on/off direction, and wherein a friction reducing means is provided between the slide surface of the supporting beam and the combplate beam.

* * * * *